US005832561A

United States Patent [19]

Bienek

[11] Patent Number: 5,832,561

[45] Date of Patent: Nov. 10, 1998

[54] AUTOMATIC DOOR CLOSER AND PROCESS FOR ASSEMBLY OF SAME

[75] Inventor: Volker Bienek, Dortmund, Germany

[73] Assignee: DORMA GmbH+Co. KG, Ennepetal, Germany

[21] Appl. No.: 735,970

[22] Filed: Oct. 23, 1996

[30] Foreign Application Priority Data

Feb. 23, 1995 [DE] Germany ..... 195 06 355.4

[51] Int. Cl.[6] ..... E05F 3/10

[52] U.S. Cl. ..... 16/53; 16/71

[58] Field of Search ..... 16/53, 60, 82, 16/52, 51, 57, 58, 59, 61, 62, 71, DIG. 10, DIG. 21

[56] References Cited

U.S. PATENT DOCUMENTS

| | | | |
|---|---|---|---|
| 1,978,736 | 10/1934 | Bommer . | |
| 3,724,023 | 4/1973 | Tillmann | 16/53 |
| 4,785,493 | 11/1988 | Tillmann et al. | 16/53 |
| 5,291,630 | 3/1994 | Brown | 16/53 |

FOREIGN PATENT DOCUMENTS

| | | | |
|---|---|---|---|
| 0469697 | 2/1992 | European Pat. Off. . | |
| 0163160 | 9/1905 | Germany . | |
| 3411189 | 10/1985 | Germany . | |
| 55376 | 3/1991 | Japan | 16/53 |
| 0156351 | 1/1921 | United Kingdom . | |
| 2244759 | 12/1991 | United Kingdom . | |

*Primary Examiner*—Chuck Mah
*Attorney, Agent, or Firm*—Nils H. Ljungman and Associates

[57] ABSTRACT

An automatic door closer has a piston assembly dividing a housing into two pressure medium chambers. The piston assembly is moveable by a cam roller in camming engagement with a cam that rotates during an opening or closing movement of a door. The piston assembly includes two parts, a coupling part and an outer part. The coupling part provides for connection to the cam roller and the outer part seals one pressure medium chamber from the other pressure medium chamber. The coupling part and the outer part are connected firmly together by a connecting element.

13 Claims, 5 Drawing Sheets

AUTOMATIC DOOR CLOSER AND PROCESS FOR ASSEMBLY OF SAME

CONTINUING APPLICATION DATA

This application is a Continuation-in-Part of International Patent Application No. PCT/DE96/00095 filed on Jan. 24, 1996, which claims priority from Federal Republic of Germany Patent Application No. 195 06 355.4, filed on Feb. 23, 1995. Internation Patent Application No. PCT/DE96/00095 was pending as of the filing date of this application and designated the United States of America as a designated state.

BACKGROUND OF THE INVENTION

1. Field of the Invention

The present invention relates to an automatic door closer having a housing in which is mounted a closer shaft driving a reciprocating cam plate, and a process for its assembly. The reciprocating cam plate engages a cam roller that is connected to a piston, the piston dividing the housing into two pressure medium chambers. In the present invention, the piston which divides the interior of the housing into two pressure medium chambers is preferably formed by a coupling part and an outer part. The connection between the coupling part and the outer part is preferably connected or made directly, positively and non-positively and with zero play with the force transmission elements which are located on the drive shaft.

In other words, the connection between the coupling part and the outer part preferably rigidly couples an axial degree of freedom of the coupling part, the outer part, and the force transmission elements (e.g., the cam roller) so as to move axially essentially as a single unit. However, the cam roller is free to rotate about its mounting as it follows the outer camming surface of the reciprocating cam plate.

2. Background Information

A known similar automatic door closer is described in German Patent No. 34 11 189.1. On this known door closer, the closer shaft is positively and non-positively connected to a reciprocating, or stroke, cam plate, whereby this reciprocating cam plate is connected to a longitudinally movable lug carriage. As a result of the rotation of the closer shaft, the lug carriage is thereby moved out of its original position, which simultaneously causes a displacement of the piston rod which is fastened to the lug carriage. The piston rod thereby runs through the compression spring which, in the free or unconnected terminal portion of the piston rod, is in contact against a piston which is coupled to the piston rod by means of a piston bolt. The piston is provided with an additional gasket and can be displaced in a cylindrical boring of the housing. Between the closing cap and the piston, there is a pressure chamber, the size of which changes as a result of the movement of the door, to regulate the damping action. To create a secure seal of the piston with respect to the cylinder wall, an additional gasket has been attached to the piston.

GB 2.244.759 A describes a piston of a door closer, which piston is not connected directly to the shaft group. The installation is made in a known manner by using a piston pin which runs through the sealing surfaces of the piston. This type of connection cannot be made outside the housing, but must be realized inside the housing.

German Patent No. 163 160 describes a door closer which is provided with a piston rod which transmits force. There is a piston surface which projects out of the piston, as a result of which the shaft drive mechanism is quite far away from the piston. As a result of this construction, the door closer is enormous in terms of its overall dimensions.

European Patent No. 0 469 697 A1 discloses a door closer in which the piston is bolted directly to a piston rod. But in this case the force of the shaft drive mechanism, which is located relatively far away from the piston, is introduced into the piston via the piston rod. This design would also be incapable of functioning without a piston rod to transmit the force, and this requirement for a piston rod therefore increases the overall length of the door closer.

OBJECT OF THE INVENTION

The object of the present invention is to improve an automatic door closer in which the overall length of the housing is reduced, but at the same time very good hydraulic function is essentially guaranteed, with an increase in the overall efficiency. An additional object of the invention is to reduce manufacturing costs.

SUMMARY OF THE INVENTION

The present invention teaches that this object can be accomplished if the damping piston which divides the interior of the housing into two chambers is preferably placed close to the drive shaft of the door closer, which can make it possible to assemble a coupling part directly with a lug carriage. For this purpose, the necessary space can be provided in the interior of the piston for the coupling flange, or coupling part, which can be connected to the lug carriage by means of a pin. This pre-assembly can be performed outside the housing, and can therefore be performed significantly more rapidly and more economically than conventional piston rod connections.

The construction of the connection in the damping piston can preferably consist of a coupling part and an outer part, whereby the outer part can be inserted over the pre-assembled coupling part after the assembly of the entire shaft group, which shaft group can include a drive shaft, a reciprocating cam plate, lugs, a system of bearings and rollers with the coupling part. For final assembly, the entire shaft group can be inserted through the housing inlet on the upper side of the door closer, and the outer part can be introduced through a lateral inlet into the housing, and thus also substantially simultaneously into the cylindrical boring of the door closer.

The outer part can thereby be inserted over the coupling part, and a positive and non-positive as well as zero-play connection between the two parts can be created by means of a connecting element. The coupling part can be designed so that the connection which is preferably present in the external surface of the piston, which connection can be in the form of a pin, could also be used in the coupling part, except that the outer part, on account of its walls, can cover this area, and simultaneously can secure the preferable pin connection in the coupling part, so that the seal inside the cylinder wall can be created essentially only by the outer part.

If the connecting pin penetrates the outer skin of the piston, as is the case in the known art, i.e. in the area where a seal with the cylinder wall is necessary, this pin must be secured. This securing is generally accomplished by caulking, and could be secured by hammering or pounding the caulking to secure the pin. But when such a known system is installed, the caulking has the disadvantage that it is not always possible to achieve the necessary precision, and thus the efficiency of the automatic door closer is reduced. Moreover, either the housing cover must be designed so that it is larger, with space to accommodate a caulking of the piston with the pin, or if the housing cover is not made larger, an additional opening must be located inside the housing, which opening in this case must then also be closed again. The presence of this additional boring or opening weakens the housing. Moreover, the manufacturing costs in such a known system are higher, and the sealing surfaces are interrupted.

As a result of the separation of the damping piston into preferably a coupling part and an outer part, the disadvantages of known similar devices can essentially be eliminated, because as early as during the preliminary assembly, the coupling part can be connected to the lugs of the shaft group, preferably by means of a pin. This pin preferably does not need to be caulked, which substantially guarantees a secure seating, because the seating of the pin, like the coupling part, can be crowned, or covered, by the outer part. As a result of this crowning, it can be no longer necessary to secure the connecting pin, and it can also be essentially guaranteed that in the vicinity of the surfaces of the damping piston and of the surrounding cylinder which pass over one another, there preferably are no interruptions or holes which would reduce the sealing effect.

In other words, the damping piston can preferably be made of two components, a coupling part and an outer part. The coupling part can be operatively pinned to a cam follower roller so as to displace axially with the cam follower roller during a closing or opening movement of the door. Because the outer diameter of the outer part component of the damping piston can preferably surround or enclose the pinned connection, a smooth and continuous outer damping piston surface can be presented to the surrounding cylinder. The pinned connection can be left unsealed, because the pinned connection need not form part of the sealing surfaces between the damping piston and the surrounding cylinder.

There are various possible methods which can be used to connect the coupling part and the outer part to one another. One of these possible methods can be to locate an extension on the coupling part, which extension can be designed so that it can be guided in the outer part. Substantially simultaneously, there can be an internal screw thread in the vicinity of this extension, by means of which, when the outer part is inserted over it, a connecting element creates a secure, positive and non-positive, zero-play connection between the coupling part and the outer part, and therefore also simultaneously between, or with, the shaft group.

In an additional type of fastening, for example, the connecting element can be connected directly outside the housing to the outer part. Or the connecting element can consist of one piece, and this pre-assembled group can be assembled inside the housing with the pre-assembled shaft group and the coupling part. In this case, however, it can be necessary to secure the outer part with the connecting element with respect to the shaft group with the coupling part. Such a securing function can be performed by a retaining ring or locking ring or similar device, or by a nut, e.g. by a threaded connection.

For the secure and controlled discharge of the damping medium which preferably can be inside the housing, and which damping medium can be displaced by the longitudinal movement of the piston from the one pressure medium chamber into the other pressure medium chamber, there can be valves and channels inside the complete piston, which can make these functions possible. For example, there can be a non-return valve which empties with its adjoining channel into a ring channel which is located inside the outer part. At the same time, a bezel (or chamfer or bevel) can also be shaped in the vicinity of the ring channel on the coupling part, which bezel can thereby represent a defined channel inside the piston when the unit has been assembled. For the discharge of the damping medium, lateral channels can preferably also have been shaped on the coupling part, which thereby can represent the connection from the pressure chamber into the unpressurized chamber.

As a result of the configuration of the teaching of the present invention described above, namely of the two-part piston and a connection capability in its interior, the size of the automatic door closer can be reduced. The housing need not be weakened by additional borings, nor does the efficiency of such a door closer need to be reduced. On the contrary, the efficiency of such a door closer can be increased.

The assembly process for such an automatic door closer can be described as follows, for a possible embodiment of the present invention. The parts of the shaft group which are in the unpressurized chamber can be completely pre-assembled outside the housing. The ability to preferably perform such a pre-assembly can result in a more precise execution of the assembly operation, because this pre-assembled shaft group can then be inserted into the housing of the door closer, preferably through the portion of the housing cover which has not yet been closed. Then, from the cylinder side of the housing which can also be preferably subsequently closed by a closing cap, the outer part can be inserted onto the coupling part. Then the connecting element can be positively and non-positively connected to the coupling part, which can also substantially simultaneously produce a positive and non-positive connection of the outer part. Then the compression spring, i.e. the energy storage mechanism, can be inserted into the housing.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present invention is described in greater detail below with reference to possible embodiments which are illustrated in the accompanying drawings, in which.

DESCRIPTION OF THE PREFERRED EMBODIMENT

Figure 1:
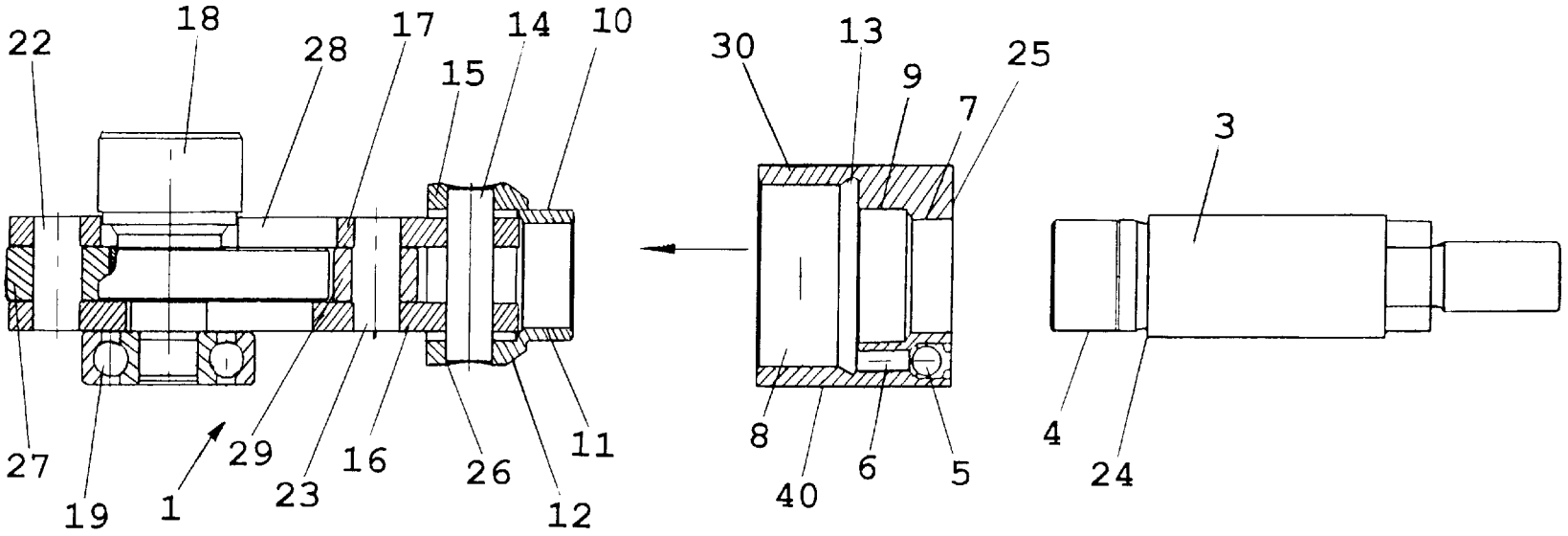
FIG. 1 shows the assembled shaft group with the coupling part, but with the outer part and the connecting element not yet assembled.

As shown in FIG. 1, a complete shaft group 1 of the automatic door closer 100 (see FIG. 2*a*) can include a drive shaft 18, with a reciprocating cam plate 28 fastened to the drive shaft 18 positively and non-positively. Lugs 16 and 17 can connect rollers, i.e., a pressure roller 27 and a support roller 29, by means of corresponding pins 22, 23.

Figure 1A:
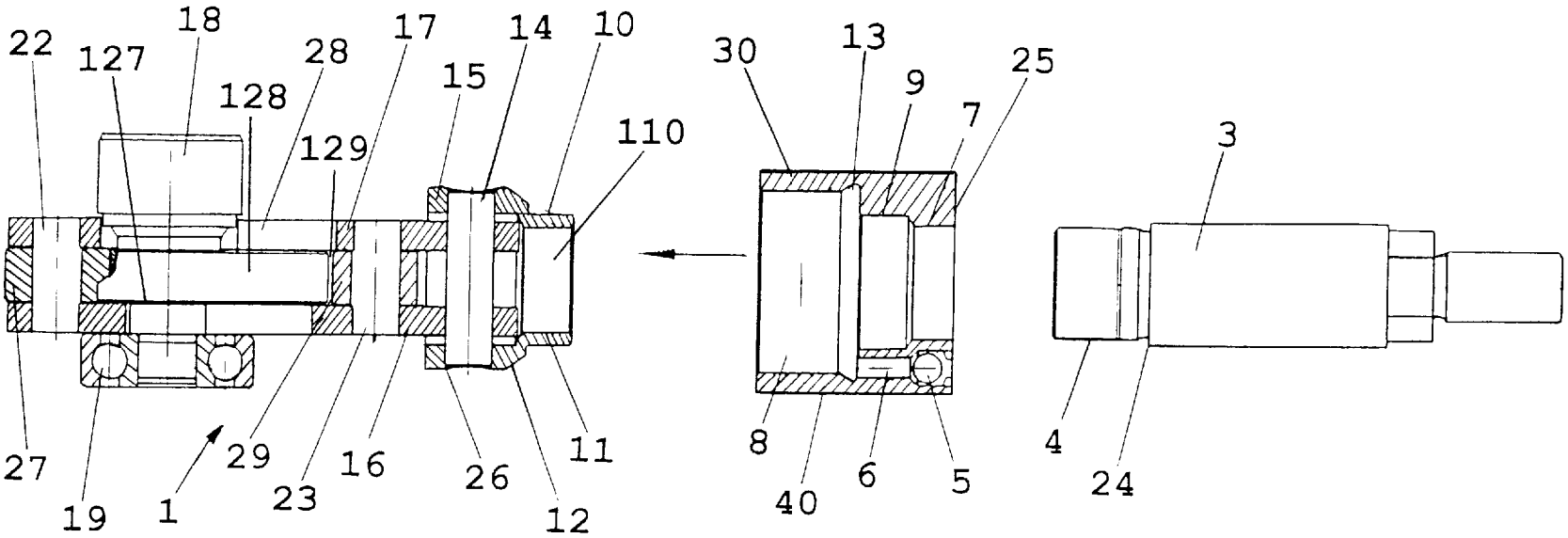
FIG. 1*a* is similar to FIG. 1 but includes additional reference numerals.

As illustrated in FIG. 1*a,* a shaft group 1 of the automatic door closer 100 (see FIG. 2*a*) can include a cam or reciprocating cam plate 28 that can rotate with the drive shaft 18. The reciprocating cam plate 28 can be in contact with the pressure roller 27 at a contact 127 and be in contact with the support roller 29 at a contact 129, such that the pressure roller 27 and the support roller 29 can be in a cam-cam follower engagement with the reciprocating cam plate 28. The outer surface 128 of the reciprocating cam plate 28 can be configured to displace the pressure roller 27 and the support roller 29 in a predetermined manner during an opening and closing rotation of the drive shaft 18. Examples of cam assemblies used in door closing apparatus can be found in the following U.S. Pat. No. 4,376,323, No. 4,658,468, No. 4,785,493 and No. 5,417,013, each of which U.S. Patents are hereby incorporated by reference as if fully set forth herein.

A further example of a cam assembly used in a door closing apparatus can be found in the following U.S. patent application, assigned to the assignee of the present application and hereby incorporated by reference as if fully set forth herein: Ser. No. 08/735,414, filed Oct. 22, 1996 and having inventor Volker Bienek, titled "Door Closer" and having Attorney Docket reference NHL-DOR-31, said U.S. patent application being a Continuation-in-Part of International Patent Application No. PCT/DE96/00096 filed on Jan. 24, 1996, which claims priority from Federal Republic of Germany Patent Application No. 195 06 220.5 filed on Feb. 22, 1995 and corresponding to DE-OS 195 06 220.5 and DE-PS 195 06 220.5.

The drive shaft 18 can be mounted in its lower portion by means of a bearing 19. Simultaneously, by means of lugs 16 and 17, a coupling part 15 for a damping device or damping piston 2 (see FIG. 2) of the automatic door closer 100 can be connected via a piston pin 14 with the lugs 16, 17. The pins 22, 23 as well as the piston pin 14 can preferably be not caulked, or not sealed, because the preferred type of construction makes it essentially unnecessary to caulk, secure or seal, these pins 14, 22 and 23.

In other words, the damping piston 2 can be a multi-piece component, and can include a coupling part 15. The coupling part 15 can be connected to the support roller 29 by means of lugs 16 and 17. The pin 23 is mounted in the lugs 16 and 17, and allows the support roller 29 to rotate as the reciprocating cam plate 28 rotates. The lugs 16 and 17 are connected to the coupling part 15 by piston pin 14. Axial displacements of either the support roller 29 and the coupling part 15 are communicated to the other of the support roller 29 and the coupling part 15 by the connection between them, i.e., by lugs 16 and 17.

The use of damping medium and energy storage devices in automatic door closers are known in the art and therefore will be described briefly. As illustrated in FIG. 2*a,* the damping piston 2 can sealingly divide a housing 20 into two pressure medium chambers, with an unpressurized chamber 31 located on an opposite side of the damping piston 2 from a pressurized chamber 32. A damping medium 131 and 132 (for example, in one possible embodiment, hydraulic fluid) can be contained within each of the chambers 31 and 32 to dampen the axial motion of the damping piston 2 within the housing 20. Hydraulic medium channels (not shown) can be provided for damping medium communication between the chambers 31 and 32.

An energy storage device can be used to store energy during an opening movement of the door to supply energy for an automatic closing of the door. For the embodiment illustrated in FIG. 2*a,* the energy storage device can include a compression spring 150. The compression spring 150 can be located between the damping piston 2 and an end 120 of the housing. An opening movement of a door (not shown) causes the drive shaft 18 to rotate, thereby causing a camming displacement of the support roller 29 and the damping piston 2 to the right. The displacement of the damping piston 2 pressurizes the pressurized chamber 32 and compresses the compression spring 150, storing energy for a subsequent closing of the door.

Referring again to FIG. 1, the coupling part 15 can be configured so that the coupling part 15 has an extension 10, in which there can be a boring 110 (see FIG. 1*a*) with an internal screw thread 11. This internal screw thread 11 can be used to connect an outer part 30 to the coupling part 15. A chamfer or bevel or bezel 12 can also be shaped on the coupling part 15, which bezel 12 preferably interacts with a ring channel 13 which can be located in the outer part 30. Hydraulic medium channels to the unpressurized chamber 31 which take off from this ring channel 13 are not shown in the embodiment illustrated in FIG. 1.

The outer part 30 can consist essentially of a bore or locator 8 for receiving the coupling part 15, with the ring channel 13 adjacent to the coupling part 15. Adjacent to the ring channel 13 can be a stepped boring 9 which preferably has essentially the same diameter as the outside diameter of extension 10 of the coupling part 15. The stepped boring 9 can be further narrowed to the boring 7. When the outer part 30 is inserted over the coupling part 15, the outer part 30 in the vicinity of the stepped boring 9 can be guided on the coupling part 15 in the vicinity of the extension 10. For the positive and non-positive connection, following the placement of the outer part 30 on the coupling part 15, a connecting element 3 which preferably has a threaded extension 4 can be screwed into the internal screw thread 11 of the coupling part 15.

Figure 2:
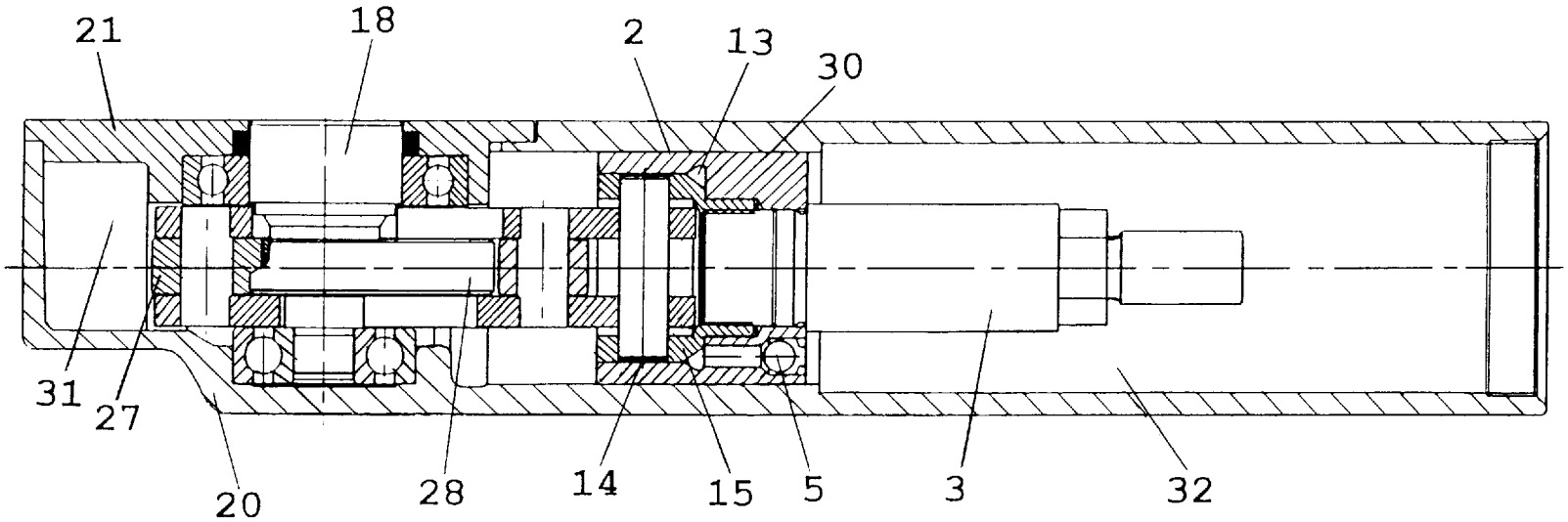
FIG. 2 is a longitudinal section through a closer housing with an assembled shaft group, piston and connecting element.
Figure 2A:
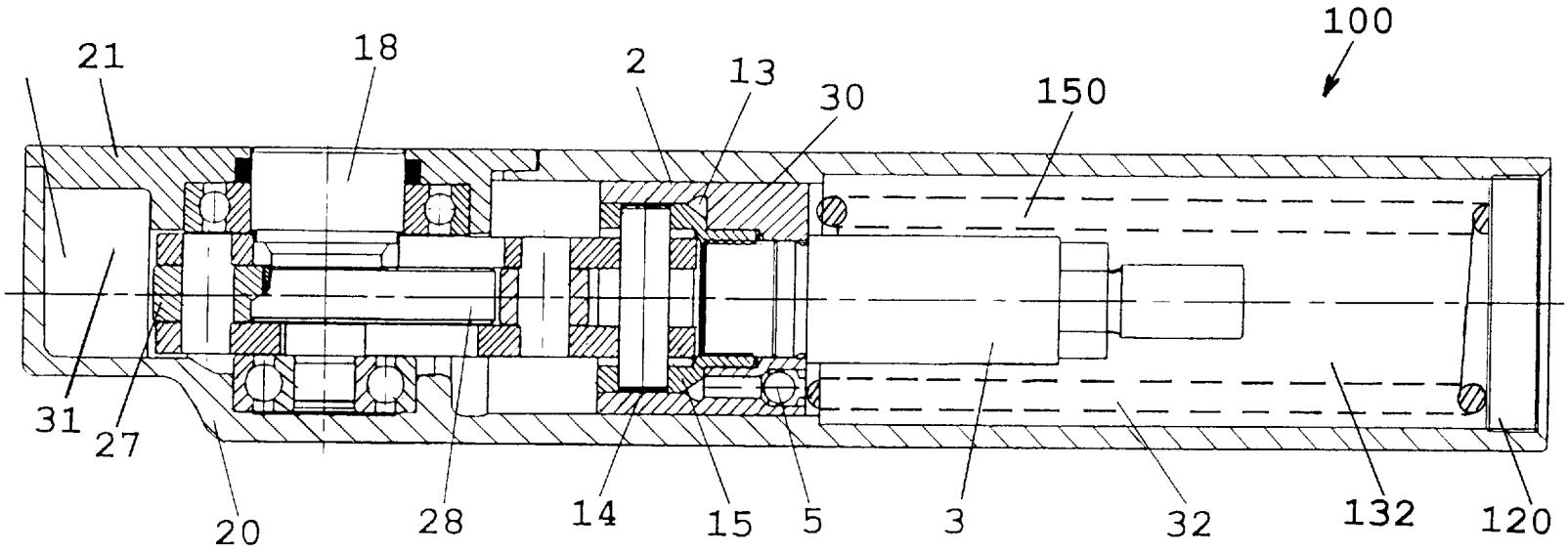
FIG. 2*a* is a longitudinal section through a closer housing with an assembled shaft group, piston, connecting element and energy storage device.

As shown in FIG. 2, when the two parts, i.e., the coupling part 15 and the connecting element 3, have been screwed together, an extension 24 (shown in FIG. 1) of the connecting element 3 can be screwed against a piston surface 25 (see FIG. 1) of the outer part 30. As a result, in addition to the positive and non-positive connection, there is also a zero-play, or substantially rigid, connection of the coupling part 15 to the outer part 30 to form the damping piston 2.

In the outer part 30 there can be at least one non-return valve 5, which ends in a channel 6. This channel 6 for its part ends in the ring channel 13, which together with the bezel 12 of the coupling part 15 can form a circular channel and can have a connection to the unpressurized chamber 31. In this manner, the damping medium 132 can be discharged from the pressurized chamber 32 into the unpressurized chamber 31.

Figure 3:
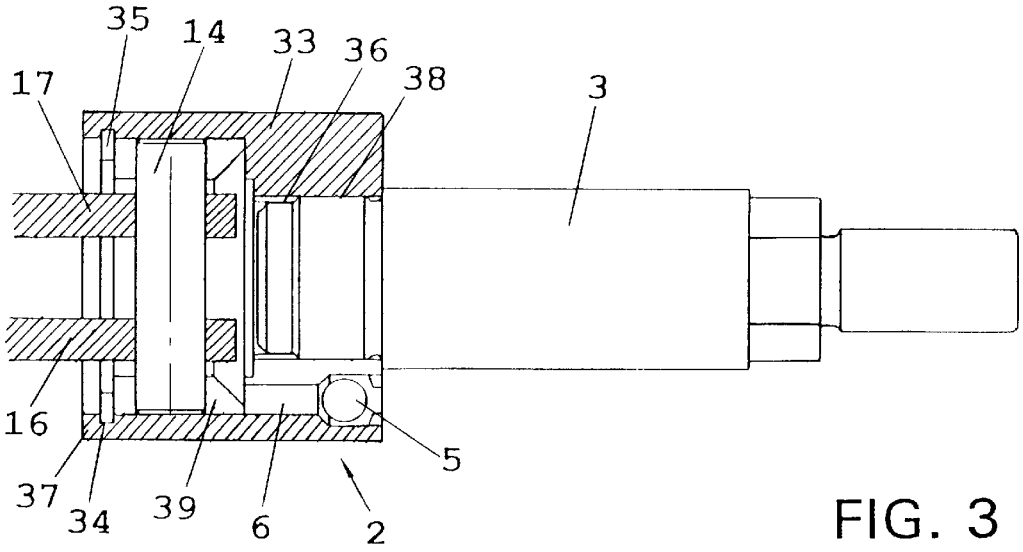
FIG. 3 is a sectional drawing of a piston connection.

FIG. 3 illustrates another type of connection, in which the lugs 16 and 17 can also be connected to one another by means of a coupling part 39 and the piston pin 14. The coupling part 39 can be configured in a somewhat different manner. In particular, the coupling part 39 can have a ring channel 36. This ring channel 36 can have a connection 37 to the channel 6 which is preferably located in the outer part 33. For assembly, the complete shaft group 1 can also be pre-assembled outside the housing 20 with the coupling part 39.

Figure 3A:
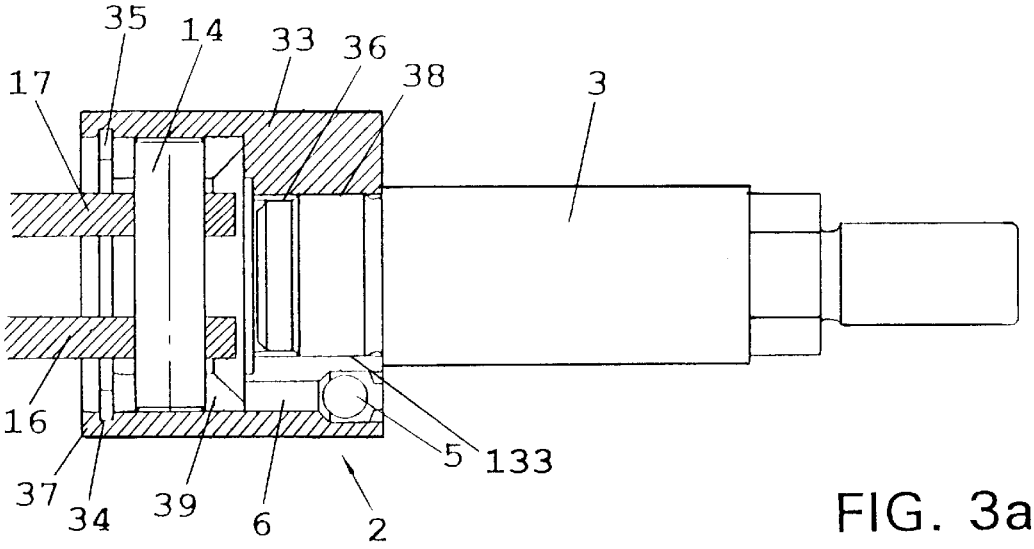
FIG. 3*a* is similar to FIG. 3 but includes additional reference numerals.

The outer part 33 can have an internal boring 133 (see FIG. 3*a*) in which the connecting element 3 is inserted outside the housing 20, namely by means of a connection 38. The connection 38 can be a threaded fastening, for example. This pre-assembled group, which includes the connecting element 3 and the outer part 33, can be introduced into the housing 20 of the door closer 100 through the pressurized chamber 32. When correctly seated, the coupling part 39 and the outer part can preferably then lie one on top of the other. A direct connection can now be made between the shaft group 1 with the coupling part 39 and the pre-assembled connecting element 3 inserted through the open portion of the housing cover 21 and the outer part 33. This direct connection can be made, for example, by means of a retaining ring 35 which is inside a groove 34 in the outer part 33. Instead of the retaining ring 35, a threaded connection can also be selected, which essentially guarantees a positive and non-positive connection between the coupling part 39 and the outer part 33.

For the assembly of the automatic door closer, FIG. 2 shows the assembled parts for one possible embodiment of the present invention. In the figure, the shaft group 1 is preferably as described above. This shaft group 1 can then be inserted into the housing 20 through an opening which can later closed by a housing cover 21. Then the outer part 30 can be placed over the coupling part 15 through the pressure chamber 32 which is preferably not yet filled with the compression spring 150 and the damping medium 131 and 132 (see FIG. 2*a*). Then the connecting element 3 can be screwed into the coupling part 15, also preferably through the pressurized chamber 32, and essentially simultaneously guarantees a zero-play, positive and non-positive connection between the inner coupling part 15 and outer part 30.

As a result of this type of assembly, the time required for the assembly process can be reduced drastically, and at the same time it can become possible to achieve a significantly higher quality. As a result of this connection, preferably consisting of the coupling part 15 or 39 and the outer part 30 or 33, respectively, which connection is fully integrated into the piston 2, there are essentially no interruptions of any type in the sealing surfaces, which contributes to an improvement of the piston function and to a reduction of wear.

One feature of the invention resides broadly in the automatic door closer with a closer shaft which can be coupled to a door panel, which closer shaft can be rotated out of a closed position in two directions of rotation, and inside a housing with a reciprocating cam plate holds positively between rollers a reciprocating cam plate, with which are engaged a system of springs which form an energy storage mechanism and the piston of a hydraulic damping device, and the interior of the door closer housing is divided into two pressure medium chambers which are separated by the piston, which pressure medium chambers are connected to one another so that the pressure medium can flow out of the pressurized chamber, which becomes smaller as the door is closed and through a non-return valve which is located in the piston and also opens during the opening movement of the door panel, characterized by the following features: the piston 9 consists of a coupling part 15 or 39; the coupling part 15 or 39 is connected positively, non-positively and without play in an outer part 30 or 33; the coupling part 15 or 39 is connected to the shaft group 1 by means of a piston pin 14; in the outer part 30 there is a non-return valve 5 with a channel 6 connected to it, which channel 6 ends in a ring channel 13 which runs inside the outer part 30; the coupling part 15 has an encircling bezel 12 which coincides with the ring channel 13; and there is a least one channel from the ring channel 13 to the unpressurized chamber 31.

Another feature of the invention resides broadly in the automatic door closer characterized by the fact that the coupling part 15 has an extension 10 with a boring which has an internal screw thread 11 in the extension 10, in which a connecting element 3 is connected by means of its threaded extension 4 through and with the outer part 30.

Yet another feature of the invention resides broadly in the automatic door closer characterized by the fact that the coupling part 39 has a ring channel 36 with a channel 37 which is connected to the ring channel 36.

Still another feature of the invention resides broadly in the automatic door closer characterized by the fact that the outer part 33 has an internal groove 34 in which a retaining ring 35 is located.

A further feature of the invention resides broadly in the automatic door closer characterized by the fact that the outer part 33 is connected to the connecting element 3 by means of a connection 38.

Examples of door closer assemblies which could be used or which could possibly be adapted for use in the context of the present invention might be disclosed by the following U.S. Patents, all of which have been assigned to the assignee of the present application: U.S. Pat. No. 5,311,642, No. 5,461,754, No. 5,417,013 and No. 5,544,462.

Further examples of door closer assemblies which could be used or which could possibly be adapted for use in the context of the present invention might be disclosed by the following U.S. Patent Applications, all of which have been assigned to the assignee of the present application: Ser. No. 08/695,791 and Ser. No. 08/597,131.

Yet another example of a door closer assembly which could be used or which could possibly be adapted for use in the context of the present invention might be disclosed by the following U.S. patent application, which has been assigned to the assignee of the present application: Ser. No. 08/733,226, filed Oct. 17, 1996, titled "Hydraulic Servo Door Closer" and having inventors Peter Krumhauer and Thomas Salutzki, and having Attorney Docket reference NHL-DOR-29 and claiming priority from Federal Republic of Germany Patent Application No. 195 38 482.2 filed Oct. 17, 1995.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 195 06 355.4, filed on Feb. 23, 1995 and PCT/DE96/00095, filed on Jan. 24, 1996, having inventor Volker Bienek, and DE-OS 195 06 355.4 and DE-PS 195 06 355.4 and International Application No. PCT/DE96/00095 and its corresponding equivalent WO 96/26344, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A door closer comprising:

a housing;

a cam device for converting between rotary motion and axial motion during an opening and closing of a door;

said cam device being disposed at least partially within said housing;

an energy storage device for storing energy during an opening of a door for subsequently closing a door;

said energy storage device being functionally connected to said cam device to act on said cam device to urge a door to a closed position;

a piston;

said piston being disposed in said housing and being moveable by said cam device;

said piston being disposed in contact with said energy storage device;

said piston comprising an inner part and an outer part;

said inner part of said piston being connected to said cam device;

said inner part of said piston being disposed within said outer part of said piston;

said outer part of said piston being frictionally and interlockingly connected to said inner part of said piston;

a pin;

said pin being disposed within said outer part of said piston;

said pin being disposed to connect said inner part of said piston to said cam device;

said piston being disposed to divide said housing into first and second chamber portions;

each of said first and second chamber portions containing damping medium;

said door closer comprising a flow path fluidly connecting said first and second chamber portions to one another;

said outer part of said piston comprising a portion;

said portion of said outer part being disposed to surround said inner part of said piston;

said portion of said outer part comprising a surface disposed to face said inner part of said piston;

said surface of said portion comprising a region disposed to define a groove extending about said inner part of said piston;

said region of said surface being disposed to define at least a portion of a ring-shaped channel extending about said inner part of said piston; and said ring-shaped channel being a portion of said flow path.

2. The door closer according to claim 1, wherein:

said ring-shaped channel represents a first channel;

said housing has a longitudinal axis;

said housing has a first end and an axially opposite second end;

said second end of said housing is disposed adjacent to said cam device;

said first chamber portion of said housing is disposed between said first end of said housing and said piston;

said piston is movable towards said first end of said housing during an opening movement of a door;

said flow path comprises a second channel;

said second channel is disposed in said outer part of said piston to fluidly connect said ring-shaped channel and said first chamber portion to one another;

said door closer comprises a valve disposed within said second channel of said flow path; and said valve is disposed to substantially open said second channel of said flow path during an opening of a door and to substantially close said second channel of said flow path during a closing of a door.

3. The door closer according to claim 2, wherein:

said inner part of said piston comprises a first surface disposed to face said outer part and substantially parallel to the longitudinal axis;

said first surface is disposed adjacent to said cam device;

said first surface of said inner part extends around the longitudinal axis;

said inner part of said piston comprises a second surface disposed to face said outer part and substantially parallel with the longitudinal axis;

said second surface is disposed adjacent to said first chamber portion;

said second surface of said inner part extends around the longitudinal axis;

said inner part of said piston comprises a third surface facing said outer part and extending between said first and second surfaces of said inner part;

said third surface of said inner part is disposed at a substantial angle with respect to the longitudinal axis;

said ring-shaped channel comprises an edge;

said third surface is disposed to define said edge of said ring-shaped channel upon said outer part of said piston being connected to said inner part of said piston;

said flow path comprises a third channel; and said third channel of said flow path is disposed to fluidly connect said ring-shaped channel and said second chamber portion of said housing to one another.

4. The door closer according to claim 3, wherein:

said inner part of said piston comprises a tubular extension;

said second surface of said inner part of said piston is disposed on said tubular extension;

said tubular extension extends a substantial distance from said third surface of said inner part towards said first end of said housing;

said tubular extension is disposed substantially parallel to the longitudinal axis;

said tubular extension comprises a first internal bore disposed substantially concentrically about the longitudinal axis;

said tubular extension defines said first internal bore;

said outer part of said piston comprises a tubular portion disposed between said tubular extension of said inner part and said first end of said housing;

said tubular portion of said outer part comprises a second internal bore disposed substantially concentrically about the longitudinal axis;

said tubular portion of said outer part defines said second internal bore;

said door closer comprises a connecting body disposed in said housing;

said connecting body is substantially cylinder-shaped;

said connecting body is disposed substantially concentrically about the longitudinal axis;

said connecting body comprises a first end portion and an axially opposite second end portion;

said first end portion of said connecting body is disposed to extend through said tubular portion of said outer part; and said first end portion of said connecting body is disposed to threadingly engage with said internal bore of said tubular extension to substantially rigidly connect said inner and outer parts of said piston to one another.

5. The door closer according to claim 4, wherein:

said cam device comprises a shaft;

said shaft has an axis of rotation defined substantially perpendicular to the longitudinal axis of said housing;

said shaft is disposed and configured to rotate in a first direction during an opening movement of a door;

said shaft is disposed and configured to rotate in a second direction during a closing movement of a door;

said cam device comprises a plate;

said plate is disposed within said housing;

said plate is attached to said shaft to rotate with said shaft;

said cam device comprises a first roller and a second roller;

said first roller and said second roller are movable together in a first direction substantially parallel with the longitudinal axis of said housing;

said first roller and said second roller are movable together in a second direction substantially parallel with the longitudinal axis of said housing;

each of said first and second rollers are disposed in camming contact with said plate to operatively convert between rotary displacement of said plate and axial displacement of said first and second rollers;

each of said first and second rollers are operatively connected to said pin; and said energy storage device comprises at least one spring disposed in said housing.

6. A door closer comprising:

a housing;

said housing having a longitudinal axis;

a cam device for converting between rotary motion and axial motion during an opening and closing of a door;

said cam device being disposed at least partially within said housing;

an energy storage device for storing energy during an opening of a door for subsequently closing a door;

said energy storage device being functionally connected to said cam device to act on said cam device to urge a door to a closed position;

a piston;

said piston being disposed in said housing and being moveable by said cam device;

said piston being disposed to contact said energy storage device;

said piston comprising an inner part and an outer part;

said inner part of said piston being connected to said cam device;

said inner part of said piston being disposed within said outer part of said piston;

said outer part of said piston being frictionally and interlockingly connected to said inner part of said piston;

a pin;

said pin being disposed within said outer part of said piston;

said pin being disposed to connect said inner part of said piston to said cam device;

said piston being disposed to divide said housing into first and second chamber portions;

each of said first and second chamber portions containing damping medium;

said door closer comprising a flow path fluidly connecting said first and second chamber portions to one another;

said inner part of said piston comprising a portion;

said portion of said inner part being disposed adjacent to said pin;

said flow path comprising a ring-shaped channel;

said ring-shaped channel being disposed within said portion of said inner part of said piston;

said ring-shaped channel extends around the longitudinal axis of said housing;

said ring-shaped channel represents a first channel;

said flow path comprising a second channel;

said second channel being disposed within said inner part of said piston; and said second channel being disposed to fluidly connect said ring-shaped channel with said second chamber portion of said housing.

7. The door closer according to claim 6, wherein:

said outer part of said piston comprises an annular portion having an inner periphery;

said annular portion of said outer part comprises a groove disposed on said inner periphery of said annular portion;

said groove is disposed adjacent to said cam device;

said groove extends around the longitudinal axis of said housing;

said door closer comprises a ring-shaped member; and said ring-shaped member is at least partially disposed within said groove to prevent relative axial movement between said inner and outer parts of said piston.

8. The door closer according to claim 7, wherein:

said housing has a first end and an axially opposite second end;

said second end of said housing is disposed adjacent to said cam device;

said outer part of said piston comprises a tubular portion;

said tubular portion of said outer part is disposed between said inner part of said piston and said first end of said housing;

said tubular portion of said outer part is disposed to define an internal bore substantially concentric with the longitudinal axis;

said door closer comprises a connecting body disposed in said housing adjacent to said first end of said housing; and at least a portion of said connecting body is disposed to threadingly engage with said internal bore of said tubular portion of said outer part to substantially rigidly connect said inner and outer piston parts to one another.

9. The door closer according to claim 8, wherein:

said door closer comprises a valve disposed within said flow path;

said valve is disposed to open said flow path during an opening of a door and to close said flow path during a closing of a door;

said cam device comprises a shaft;

said shaft has an axis of rotation defined substantially perpendicular to the longitudinal axis of said housing;

said shaft is disposed and configured to rotate in a first direction during an opening movement of a door;

said shaft is disposed and configured to rotate in a second direction during a closing movement of a door;

said cam device comprises a plate;

said plate is disposed within said housing;

said plate is attached to said shaft to rotate with said shaft;

said cam device comprises a first roller and a second roller;

said first roller and said second roller are movable together in a first direction substantially parallel with the longitudinal axis of said housing;

said first roller and said second roller are movable together in a second direction substantially parallel with the longitudinal axis of said housing;

each of said first and second rollers are disposed in camming contact with said plate to operatively convert between rotary displacement of said plate and axial displacement of said first and second rollers;

each of said first and second rollers are operatively connected to said pin; and said energy storage device comprises at least one spring disposed in said housing.

10. A door closer comprising:

a housing;

said housing having a longitudinal axis;

cam means for converting between rotary motion and axial motion during an opening and closing of a door;

said cam means being disposed at least partially within said housing;

energy storage means for storing energy during an opening of a door for subsequently closing a door;

said energy storage means being functionally connected to said cam means to act on said cam means to urge a door to a closed position;

a piston;

said piston being disposed in said housing and being displaceable by said cam means;

said piston being disposed to contact said energy storage means;

said piston comprising an inner part and an outer part;

said inner part of said piston being connected to said cam means;

said inner part of said piston being disposed within said outer part of said piston;

said outer part of said piston being frictionally and interlockingly connected to said inner part of said piston;

said door closer comprising a member;

said member being disposed within said outer part of said piston;

said member being disposed to pin said inner part of said piston to said cam means to transfer axial motion of said cam means to said piston;

said outer part of said piston comprising a portion;

said portion of said outer part comprising an annular groove extending around the longitudinal axis of said housing;

said groove being disposed adjacent to said member;

said door closer comprising a ring-shaped member; and said ring-shaped member being disposed within said groove to prevent relative axial movement between said inner and outer parts of said piston.

11. The door closer according to claim 10, wherein:

said housing has a first end and an axially opposite second end;

said second end of said housing is disposed adjacent to said cam means;

said outer part of said piston comprises a tubular portion;

said tubular portion of said outer part is disposed between said inner part of said piston and said first end of said housing;

said tubular portion of said outer part is disposed to define an internal bore substantially concentric with the longitudinal axis;

said door closer comprises a connecting body disposed in said housing adjacent to said first end of said housing; and at least a portion of said body is disposed to threadingly engage with said internal bore of said tubular portion of said outer part to substantially rigidly connect said inner and outer piston parts to one another.

12. The door closer according to claim 11, wherein:

said piston is disposed to divide said housing into first and second chamber portions;

said first chamber portion is disposed adjacent to said first end of said housing;

each of said first and second chamber portions contains damping medium;

said door closer comprises a flow path fluidly connecting said first and second chamber portions to one another;

said inner part of said piston comprises a portion;

said portion of said inner part of said piston is disposed adjacent to said pin;

said flow path comprises a ring-shaped channel;

said ring-shaped channel is disposed within said portion of said inner part of said piston;

said ring-shaped channel extends around the longitudinal axis of said housing;

said ring-shaped channel represents a first channel;

said flow path comprises a second channel;

said second channel is disposed within said outer part of said piston; and said second channel is disposed to fluidly connect said ring-shaped channel with said first chamber portion of said housing.

13. The door closer according to claim 12, wherein:

said door closer comprises a valve disposed within said second channel;

said valve is disposed to open said flow path during an opening of a door and to close said flow path during a closing of a door;

said cam means comprises a shaft;

said shaft has an axis of rotation defined substantially perpendicular to the longitudinal axis of said housing;

said shaft is disposed and configured to rotate in a first direction during an opening movement of a door;

said shaft is disposed and configured to rotate in a second direction during a closing movement of a door;

said cam means comprises a plate;

said plate is disposed within said housing;

said plate is attached to said shaft to rotate with said shaft;

said cam means comprises a first roller and a second roller;

said first roller and said second roller are movable together in a first direction substantially parallel with the longitudinal axis of said housing;

said first roller and said second roller are movable together in a second direction substantially parallel with the longitudinal axis of said housing;

each of said first and second rollers are disposed in camming contact with said plate to operatively convert between rotary displacement of said plate and axial displacement of said first and second rollers;

each of said first and second rollers are operatively connected to said member; and said energy storage means comprises at least one spring disposed in said housing.

* * * * *